US009803654B2

(12) United States Patent
Yagi et al.

(10) Patent No.: US 9,803,654 B2
(45) Date of Patent: Oct. 31, 2017

(54) IMPELLER, AND ROTATING MACHINE PROVIDED WITH SAME

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventors: Nobuyori Yagi, Tokyo (JP); Hiroyuki Miyata, Hiroshima (JP)

(73) Assignees: MITSUBISHI HEAVY INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 232 days.

(21) Appl. No.: 14/417,722

(22) PCT Filed: Oct. 29, 2013

(86) PCT No.: PCT/JP2013/079220

§ 371 (c)(1),
(2) Date: Jan. 27, 2015

(87) PCT Pub. No.: WO2014/069439

PCT Pub. Date: May 8, 2014

(65) Prior Publication Data

US 2015/0226233 A1 Aug. 13, 2015

(30) Foreign Application Priority Data

Oct. 30, 2012 (JP) ..... 2012-238740

(51) Int. Cl.
*F04D 17/10* (2006.01)
*F04D 29/66* (2006.01)
(Continued)

(52) U.S. Cl.
CPC ..... *F04D 29/662* (2013.01); *F01D 5/027* (2013.01); *F01D 5/04* (2013.01); *F04D 17/10* (2013.01);
(Continued)

(58) Field of Classification Search
CPC . F01D 5/04; F01D 5/027; F04D 17/10; F04D 25/163; F04D 29/284; F04D 29/662; F04D 29/668
See application file for complete search history.

(56) References Cited

U.S. PATENT DOCUMENTS 4,842,485 A 6/1989 Barber
5,129,284 A 7/1992 Brueckner et al.
(Continued)

FOREIGN PATENT DOCUMENTS

CN 1035341 A 9/1989
DE 958 147 C 2/1957
(Continued)

OTHER PUBLICATIONS

Chinese Office Action and Chinese Search Report, issued Mar. 29, 2016, for Chinese Application No. 201380038434.4, along with English translations.
(Continued)

*Primary Examiner* — Igor Kershteyn
(74) *Attorney, Agent, or Firm* — Birch, Stewart, Kolasch & Birch, LLP

(57) ABSTRACT

The invention includes a disc-shaped disc section (30) that is attached to a rotating shaft (6), and blade sections (40) that are provided on a front surface (31) that is one side in an axial direction of the disc section (30). Balance holes (33) for attaching weight-adjusting weight members W thereto are provided at positions where the blade sections (40) are
(Continued)

provided in a radial direction, in a rear surface (51) that is the other side in the axial direction of the disc section (30).

4 Claims, 8 Drawing Sheets

(51) Int. Cl.

| | |
|---|---|
| ***F04D 25/16*** | (2006.01) |
| ***F04D 29/28*** | (2006.01) |
| ***F01D 5/02*** | (2006.01) |
| ***F01D 5/04*** | (2006.01) |

(52) U.S. Cl.
CPC ..... *F04D 25/163* (2013.01); *F04D 29/284* (2013.01); *F04D 29/668* (2013.01)

(56) References Cited

U.S. PATENT DOCUMENTS

| | | | | |
|---|---|---|---|---|
| 5,591,008 | A | 1/1997 | Wrobel et al. | |
| 7,281,896 | B2 * | 10/2007 | Yu | F04D 29/329 416/144 |
| 7,717,679 | B2 * | 5/2010 | He | F04D 25/0613 416/144 |
| 7,927,074 | B2 * | 4/2011 | Sun | F04D 25/0613 416/144 |
| 8,784,058 | B2 * | 7/2014 | Schneider | F04D 29/662 416/144 |
| 8,974,199 | B2 * | 3/2015 | Schmid | F04D 29/662 417/423.7 |
| 2005/0150322 | A1 * | 7/2005 | Rocky | F16F 15/32 74/572.4 |
| 2005/0249596 | A1 * | 11/2005 | Hsieh | F04D 29/662 416/144 |
| 2005/0265846 | A1 | 12/2005 | Przytulski et al. | |
| 2006/0133938 | A1 | 6/2006 | Ellis et al. | |
| 2008/0131283 | A1 * | 6/2008 | Elsaesser | F23D 14/02 416/247 R |
| 2009/0304509 | A1 | 12/2009 | Blanchard et al. | |
| 2010/0074752 | A1 | 3/2010 | Denis et al. | |
| 2010/0278634 | A1 | 11/2010 | Koza et al. | |

FOREIGN PATENT DOCUMENTS

| | | | |
|---|---|---|---|
| DE | 8806991 | U1 | 8/1988 |
| DE | 20 2006 010 094 | U1 | 11/2006 |
| EP | 1 052 424 | A2 | 11/2000 |
| JP | 54-017905 | | 2/1979 |
| JP | 55-049019 | U | 3/1980 |
| JP | 8-326849 | A | 12/1996 |
| JP | 2000-356107 | A | 12/2000 |
| JP | 2008-291657 | A | 12/2008 |
| JP | 2009-174692 | A | 8/2009 |
| JP | 2012-502213 | A | 1/2012 |
| WO | 02/097279 | A1 | 12/2002 |

OTHER PUBLICATIONS

European Search Report mailed Jun. 24, 2016 in counterpart European Application No. 13851658.8.

International Search Report, issued in PCT/JP2013/079220, mailed Dec. 24, 2013.

Walter D. Pilkey, "Stress Concentration Factors", Second Edition, A Wiley-Interscience Publication, 1997, p. 66.

Written Opinion of the International Search Report, issued in PCT/JP2013/079220, mailed Dec. 24, 2013.

Office Action mailed Aug. 16, 2016 in JP Application No. 2012-238740 with an English Translation.

* cited by examiner

IMPELLER, AND ROTATING MACHINE PROVIDED WITH SAME

TECHNICAL FIELD

The present invention relates to an impeller, and a rotating machine in which the impeller is fixed to a rotating shaft.

Priority is claimed on Japanese Patent Application No. 2012-238740, filed Oct. 30, 2012, the content of which is incorporated herein by reference.

BACKGROUND ART

Rotating machines, such as a centrifugal compressor, are used for turbo refrigerators or small-sized gas turbines. This rotating machine has the impeller in which a disc section fixed to the rotating shaft is provided with a plurality of blade sections. The rotating machine gives pressure energy and speed energy to gas by the impeller being rotated.

The impeller is attached to a rotor shaft by shrinkage fitting or the like. However, the unbalance of mass may occur in a circumferential direction due to the positional deviation of incorporation into the rotor shaft, a manufacturing error at the time of machining, or the like. For example, when the central axis of the mass of a rotary body is inclined with respect to the rotation center of the rotor shaft, a centrifugal force is generated by rotation whereby the unbalance of a moment or dynamic unbalance occurs. Therefore, since shaft vibration may increase, adjustment is performed in advance before an operation, such as at the time of manufacture, at the time of a test operation, or at the time of field installation.

Particularly, when the impeller is constituted of a single stage and has an overhang shaft structure, as in a speed increasing gear built-in type geared compressor, it is necessary to attach a weight for performing balance adjustment to an impeller.

Thus, in order to prevent vibration resulting from the unbalance of the rotary body, it is suggested that the blade sections of a fan or the impeller are supported and a plurality of balance holes with different depths are provided in an axial end surface of a tube portion of the disc section attached to the rotor shaft so as to perform balance adjustment. Moreover, it is suggested that balance adjustment is performed by appropriately mounting weights on the plurality of balance holes (for example, refer to Patent Documents 1 to 3).

PRIOR ART DOCUMENT

Patent Document

Patent Document 1: Published Japanese Translation No. 2012-502213 of the PCT International Publication Patent Document 2: Japanese Unexamined Patent Application, First Publication No. 2000-356107

Patent Document 3: Japanese Unexamined Patent Application, First Publication No. 2008-291657

SUMMARY OF INVENTION

Technical Problem

Meanwhile, in the above impeller, it is desired that balance adjustment is performed on the spot where an apparatus is delivered, and the validity thereof is verified. However, when the balance holes are provided in the axial end surface of the tube portion of the disc section as described above, the balance holes cannot be accessed unless parts, which are adjacent to the tube portion of the impeller, such as suction piping, are detached. Since detachment work of these parts adjacent to tube portions requires skill and takes substantial time and effort, lead time related to the balance adjustment becomes long.

The invention provides an impeller and a rotating machine provided with the same that can rapidly and easily perform balance adjustment on the spot where an apparatus is installed.

Technical Solution

According to a first aspect of the invention, an impeller includes a disc-shaped disc section that is attached to a rotating shaft; and a blade section that is provided in a surface that is one side in an axial direction of the disc section. The blade section is provided with an attachment hole for attaching a weight-adjusting weight, in a back surface that is the other side in the axial direction of the disc section.

According to a second aspect of the invention, the disc section in the impeller of the first aspect may include a stress-relaxing device that is provided on at least one radial side of the attachment hole in the back surface and relaxes stress concentration caused by a centrifugal force in the attachment hole.

According to a third aspect of the invention, as for the impeller, the stress-relaxing device in the impeller of the second aspect may include an axial wall portion that blocks a radial stress in a meridian plane, on at least one radial side of the attachment hole.

According to a fourth aspect of the invention, a rotating machine includes a rotor having the impeller according to any one aspect of the above first to third aspects.

Advantageous Effects

According to the above-described impeller and rotating machine, it is possible to rapidly and easily perform balance adjustment on the spot where an apparatus is installed.

DESCRIPTION OF EMBODIMENTS

Next, a rotating machine and an impeller in a first embodiment of the invention will be described with reference to the drawings.

Figure 1:
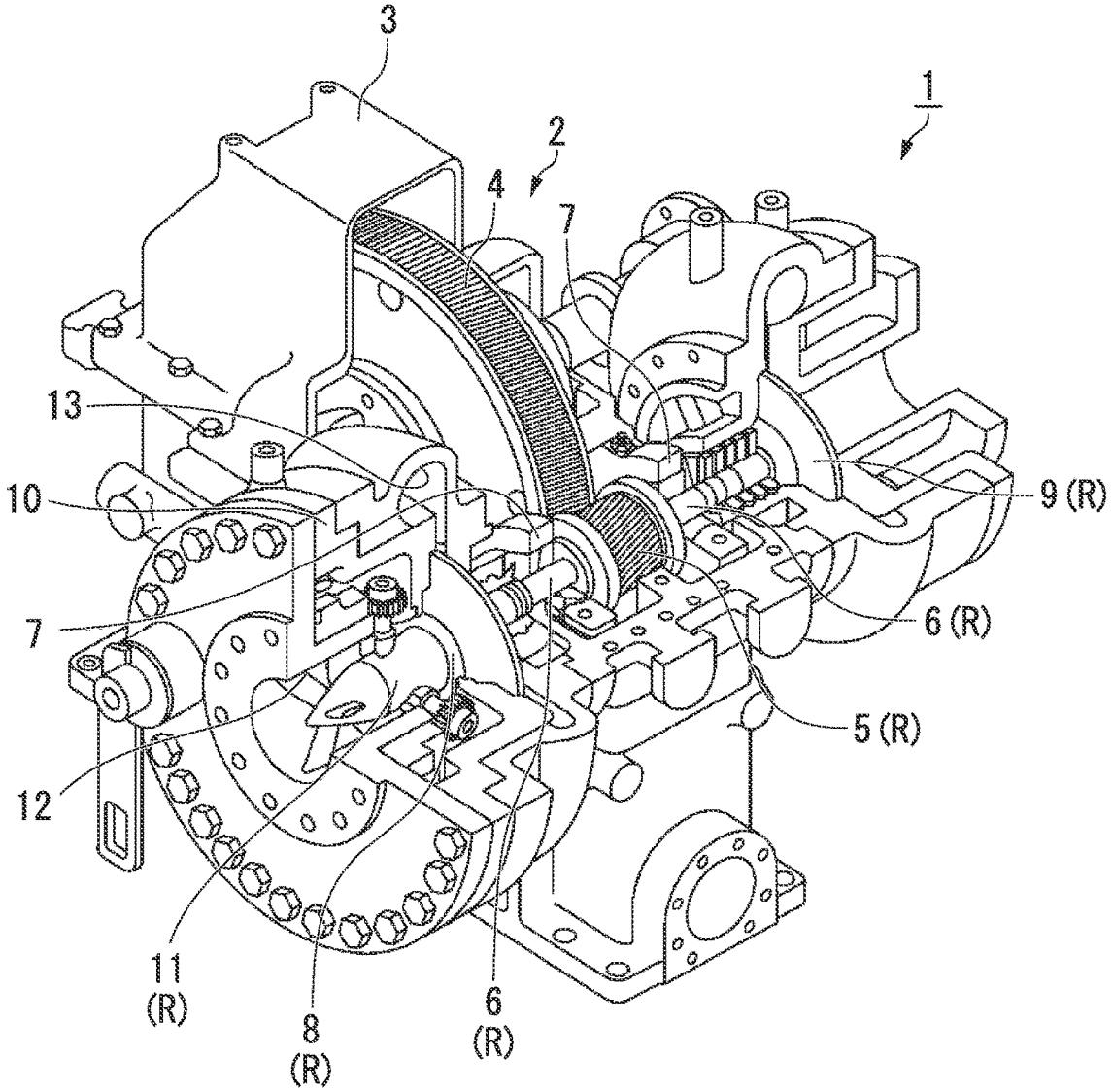
FIG. 1 is a partial cross-sectional perspective view of a centrifugal compressor in embodiments of the invention.

FIG. 1 is a perspective view illustrating a centrifugal compressor 1 that is a rotating machine of this embodiment.

As illustrated in FIG. 1, the centrifugal compressor 1 is a so-called geared compressor having a speed-increasing mechanism 2 built therein. The speed-increasing mechanism 2 includes a gear 4 that is rotationally driven by a driving source (not illustrated) and is covered with a cover 3. A pinion 5 that is a gear sufficiently smaller than the gear 4 is meshed with the gear 4. The pinion 5 is fixed to a central portion, in a longitudinal direction, of a pinion shaft 6 that is rotatably supported by a bearing 7.

The pinion shaft 6 in this embodiment has impellers 8 and 9 respectively attached to both end portions thereof. The impellers 8 and 9 have a cantilevered structure with respect to the bearing 7. The impellers 8 and 9 respectively compress and pass gas G supplied from an upstream flow passage (not illustrated), using a centrifugal force generated by the rotation of the pinion shaft 6.

Figure 2:
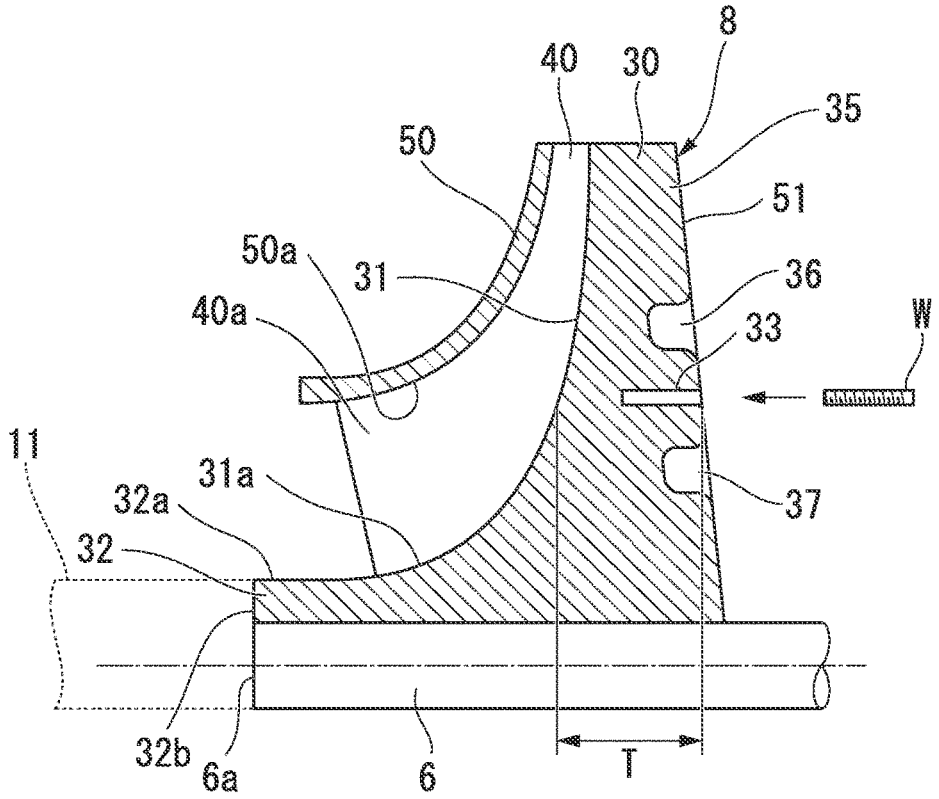
FIG. 2 is a meridian cross-sectional view of an impeller in a first embodiment of the invention.

A casing 10 is formed with a suction passage 12 into which gas G is made to flow from the upstream flow passage, and a discharge passage 13 for causing the gas G to flow out to the outside. Additionally, the lid portion 11 is arranged at a central portion of an internal space of the suction passage 12 axially outside the impellers 8 and 9. Here, a rotor R of this embodiment is constituted of the impellers 8 and 9, the pinion shaft 6, the lid portion 11, and the pinion 5. In FIG. 2, an axial direction is illustrated by a one-dot chain line.

By virtue of the configuration of the centrifugal compressor 1, the gas G that has flowed into the suction passage 12 is compressed by impellers 8 and 9 when the pinion shaft 6 rotates via the speed-increasing mechanism 2. Thereafter, the compressed gas G is discharged to the outside of the casing 10 via the discharge passage 13 radially outside the impellers 8 and 9. Since the impellers 8 and 9 have the same shape, only the impeller 8 will be described in detail in the following description. In the following description of the impeller 8, a side into which the gas G flows is referred to as a front side with respect to the axis of the pinion shaft 6, and a side opposite to the front side is referred to as a rear side (or back side). When there is no particular description in the following description, the "radial direction" refers to a radial direction of the impellers 8 and 9, and the "axial direction" refers to an axial direction of the rotor R.

FIG. 2 illustrates a meridian plane of the impeller 8. As illustrated in FIG. 2, the impeller 8 of the centrifugal compressor 1 includes a disc section 30, a plurality of blade sections 40, and a cover section 50. The centrifugal compressor 1 has a so-called closed type impeller.

The disc section 30 is fixed to the pinion shaft 6 by shrinkage fitting or the like.

A plurality of blade sections 40 are provided so as to protrude from a front surface (a surface that becomes one side in the axial direction) 31 of the disc section 30.

The cover section 50 has a ring shape in a front view, which is formed at front ends of the blade sections 40.

The meridian plane of the impeller 8 means a longitudinal section passing through the meridian of the impeller 8 having a circular shape in a front view and the axis of the pinion shaft 6.

The disc section 30 includes a substantially cylindrical tube portion 32 that is externally fitted to the pinion shaft 6. The disc section 30 includes a disc-shaped disc body portion 35, which extends radially outward from the tube portion 32, on a rear side in the direction of the axis thereof. The disc body portion 35 is formed so as to become thicker radially inward. The disc body portion 35 includes a concave curved surface 31*a* that smoothly connects a front surface 31, and an outer peripheral surface 32*a* of the tube portion 32. The above-described lid portion 11 (refer to FIG. 1) is attached so as to cover an end surface 32*b* of the tube portion 32 and an end surface 6*a* of the pinion shaft 6 from an outer side in the axial direction. Therefore, in order to make an access to the end surface 32*b* on the outer side in the axial direction of the tube portion 32, it is necessary to detach the above-described casing 10 and lid portion 11.

The plurality of blade sections 40 are arrayed at equal intervals in a circumferential direction of the disc body portion 35. The blade sections 40 have a substantially constant plate thickness. The blade sections 40 are formed in a tapered shape radially outward in a side view. That is, a gas flow passage of the impeller 8 is defined by the front surface 31, the curved surface 31*a*, the outer peripheral surface 32*a*, surfaces 40*a* of the blade section 40 that face each other in the circumferential direction, and a wall surface 50*a* of the cover section 50 that faces the front surface 31 and the curved surface 31*a*.

Figure 3:
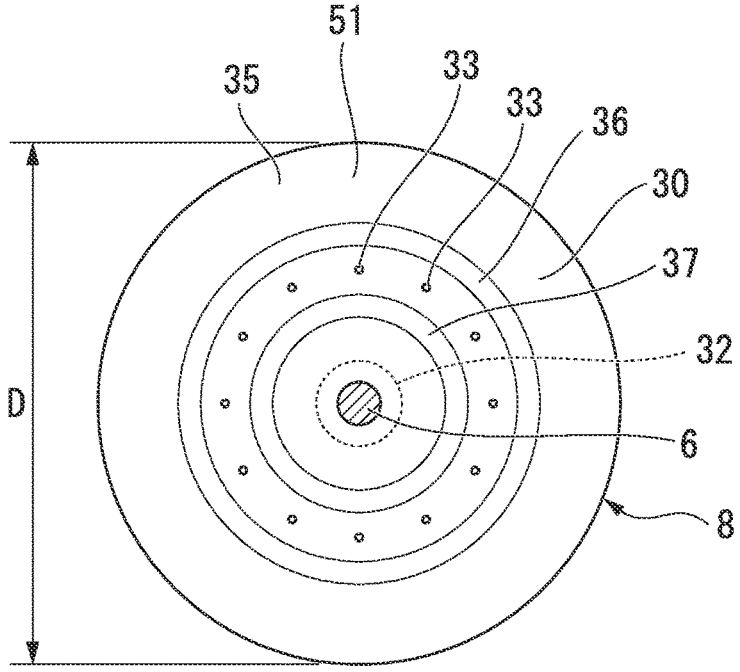
FIG. 3 is a back view of the impeller.

As illustrated in FIGS. 2 and 3, the disc section 30 has a plurality of balance holes 33 on a rear surface (a back surface that becomes the other side in the axial direction) 51 thereof. More specifically, the disc section 30 includes the balance holes 33 that are equal to or more than the number of the blade sections 40. The balance holes 33 are arranged side by side at predetermined intervals in the circumferential direction at a radial intermediate position of the disc section 30 where the blade sections 40 are provided in the radial direction. The balance holes 33 are formed with a predetermined depth in the axial direction. Additionally, a female thread is formed in an inner peripheral surface of each balance hole 33 so as to enable a weight-adjusting weight member W having a male thread shape to be screwed thereto. It is preferable that the above-described predetermined depth of the balance holes 33 be, for example, a depth from T/2 to T/4 in consideration of the strength reduction of the disc body portion 35 if the axial thickness of the disc body portion 35 at a radial position where a balance hole 33 is formed is defined as "T". The internal diameter of the balance holes is set according to the external diameter of the impeller 8. For example, if the external diameter of the impeller 8 is defined as "D", the internal diameter of the balance holes is about 0.004 D to about 0.060 D. The weight members W having various kinds of weight are prepared in advance.

Figure 4:
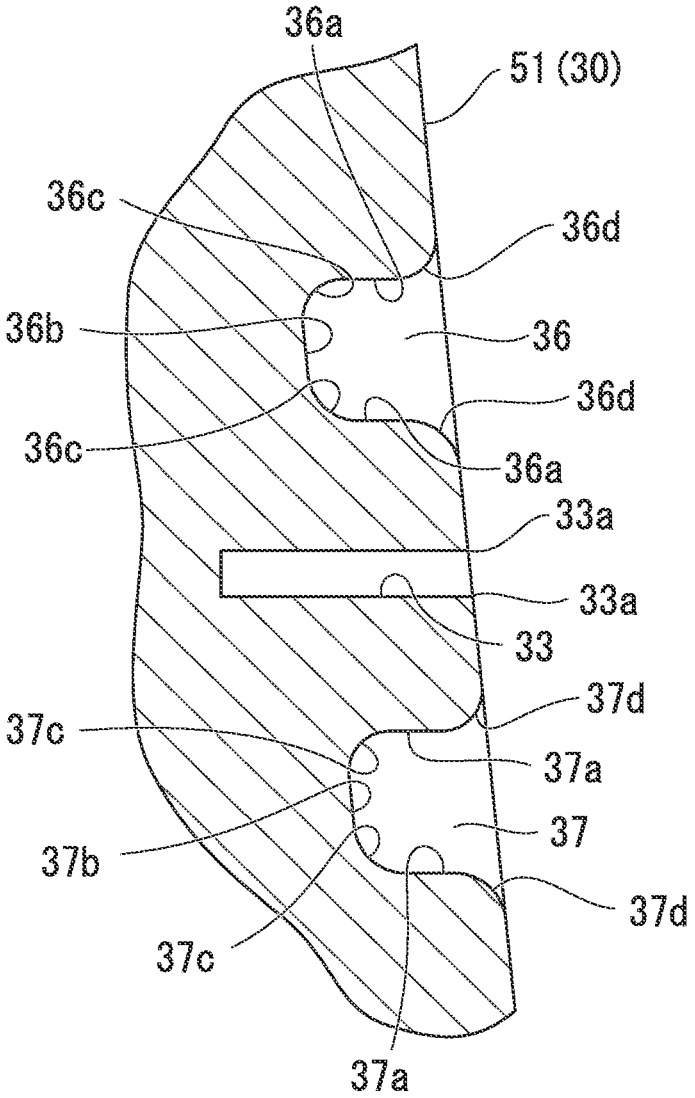
FIG. 4 is an enlarged view of balance hole peripheral edges of the impeller.

As illustrated in FIGS. 2 to 4, stress-relaxing recesses 36 and 37 are formed radially outside the balance holes 33 and radially inside the balance holes 33, respectively, in a rear surface 51 of the disc section 30. The stress-relaxing recesses 36 and 37 are formed in a substantially annular shape. Concave curved surfaces 36*c* or 37*c* are formed between facing inner surfaces 36*a* or 37*a* of the stress-relaxing recess 36 or 37 and a bottom surface 36*b* or 37*b* that connects axial front end portions of the inner surfaces 36*a* or 37*a*. Convex curved surfaces 36*d* or 37*d* are formed between the inner surfaces 36*a* or 37*a* and the rear surface 51. The depth of the stress-relaxing recesses 36 and 37 from the rear surface 51 to the deepest portion is equal to or less than T/2. The radial groove width of the stress-relaxing recesses 36 and 37 is equal to or more than 0.004 D.

Figure 5A:
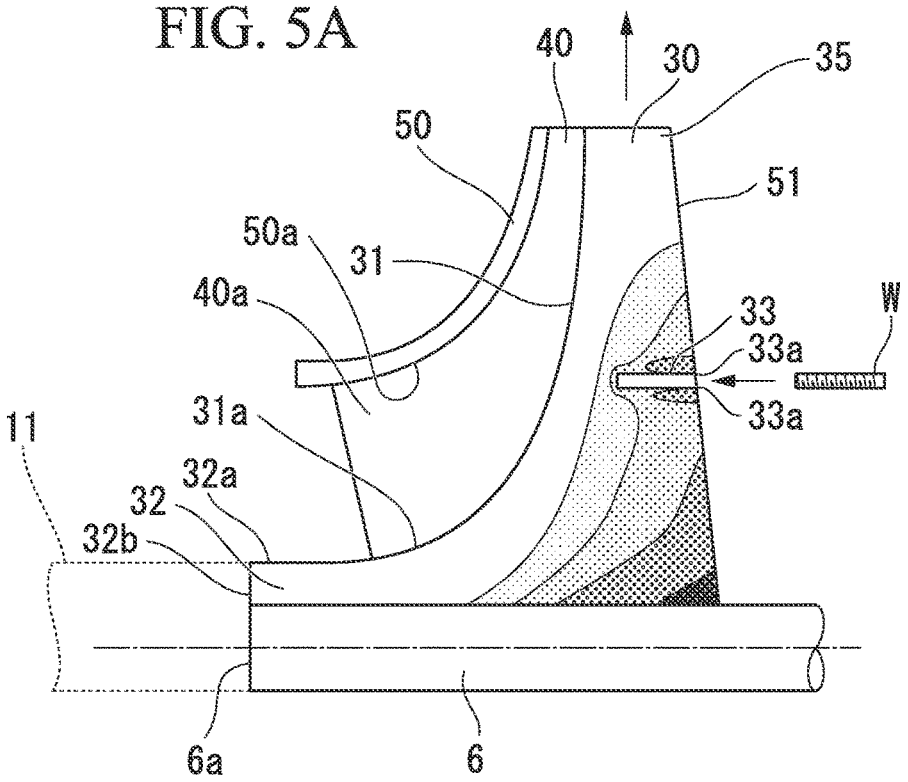
FIG. 5A is an explanatory view of a stress that acts on a disc section of the impeller, in a comparative example in which stress-relaxing recesses are not provided.

FIG. 5A is a view for explaining a stress that acts on the impeller 8, in a case where the stress-relaxing recesses 36 and 37 are not provided. Additionally, FIG. 5B is a view for explaining a stress that acts on the impeller 8, in a case where the stress-relaxing recesses 36 and 37 are provided.

When the stress-relaxing recesses 36 and 37 are not provided as illustrated in FIG. 5A, a centrifugal force acts on the disc section 30 radially outward (illustrated by an arrow) as the impeller 8 rotates. A tensile stress is generated in the disc body portion 35 by this centrifugal force. This tensile stress becomes highest at a radial inner corner portion of the rear surface 51 in the impeller 8 and is locally high at corner portions 33*a* of a balance hole 33 due to stress concentration.

Figure 5B:
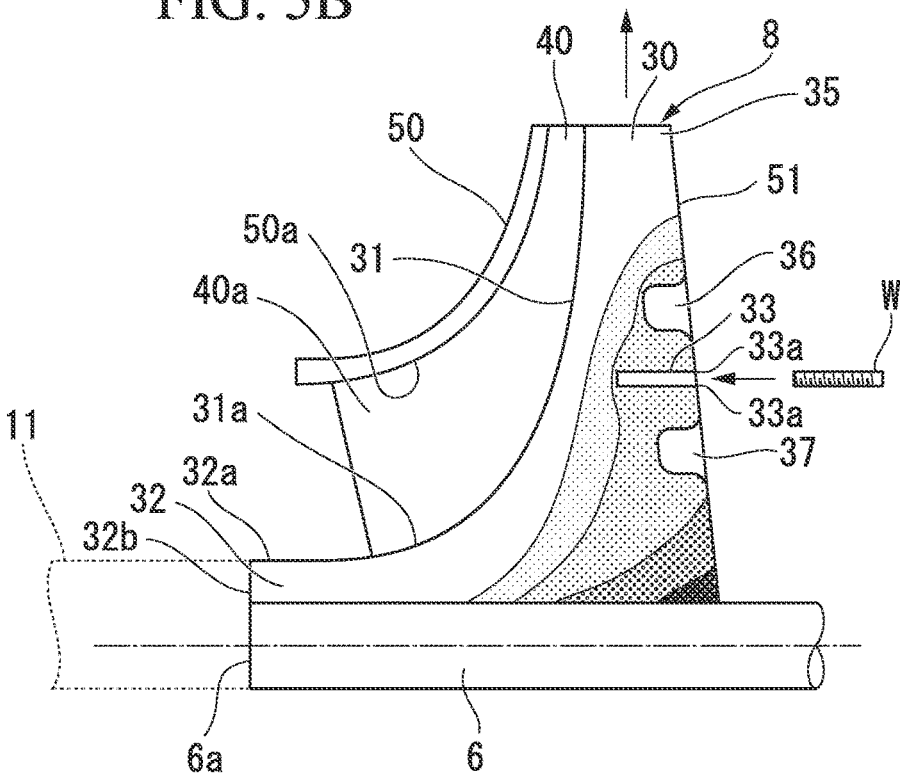
FIG. 5B is an explanatory view of a stress that acts on the disc section of the impeller, in a case where the stress-relaxing recesses are provided.

In contrast, when the stress-relaxing recesses 36 and 37 are provided as illustrated in FIG. 5B, even if a tensile stress acts on the disc body portion 35 due to the centrifugal force, a radial tensile stress in the meridian plane of the stress-relaxing recess 36 or 37 acts so as to divert the facing inner surfaces 36*a* or 37*a* of the stress-relaxing recess 36 or 37 and the balance hole 33. Therefore, the stress concentration of the tensile stress in the corner portions 33*a* of the balance hole 33 is suppressed.

Accordingly, according to the impeller 8 and the centrifugal compressor 1 of the above-described first embodiment, the weight member can be appropriately mounted into the balance hole 33 by detaching the casing 10 that covers the impeller 8 from a radial outer side without detaching components, such as the lid portion 11 and the suction passage 12, which are adjacent to each other in the axial direction of the disc section 30. Therefore, it is possible to rapidly and easily perform balance adjustment of the impeller 8 on the spot where the centrifugal compressor 1 is installed.

Additionally, since the stress concentration onto the balance hole 33 caused by the centrifugal force during rotation can be relaxed by the stress-relaxing recesses 36 and 37, the fatigue caused by the stress concentration can be suppressed. As a result, it is possible for the impeller 8 to correspond to high-speed rotation by the relaxed amount of the stress concentration.

Moreover, as the stress-relaxing recess 36 or 37 is formed with the curved surfaces 36*c* and 36*d* or 37*c* and 37*d*, it is possible to further relax the stress concentration.

Next, an impeller 108 in a second embodiment of the invention will be described with reference to the drawings. The impeller 108 of the second embodiment is different from the impeller 8 of the above-described first embodiment in the shape of stress-relaxing device. Therefore, FIG. 1 is incorporated herein by reference, and the same portions as those of the above-described first embodiment will be designated and described by the same reference numerals (hereinafter, this is also the same in the second to fourth embodiments).

Figure 6:
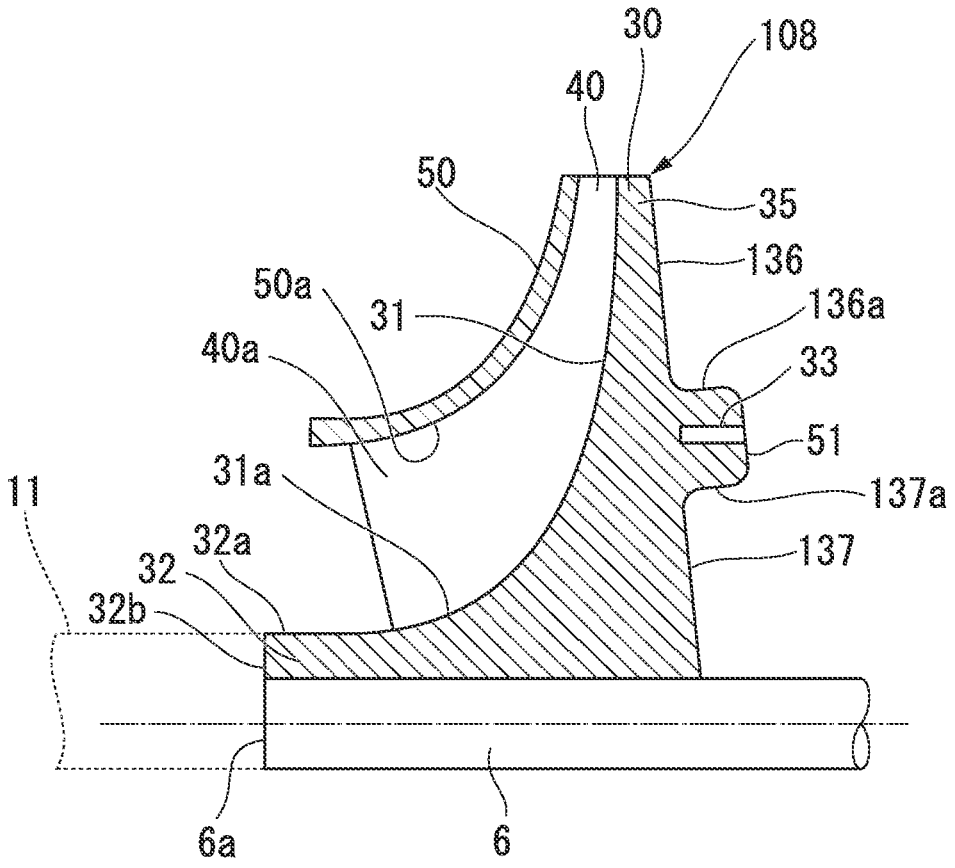
FIG. 6 is a meridian cross-sectional view correspond to FIG. 2 in a second embodiment of the invention.

As illustrated in FIG. 6, in the impeller 108 of the second embodiment, similar to the first embodiment, the balance holes 33 are formed in the rear surface 51 of the disc section 130. Stress-relaxing thinned portions (stress-relaxing device) 136 and 137 are respectively formed radially inside and radially outside the balance holes 33 of the impeller 108. More specifically, wall portions 136*a* and 137*a* that extend to the front side in the axial direction are formed at positions away by predetermined distances radially inward and radially outward from the balance holes 33. Moreover, spaces where the rear surface 51 of the disc section 130 is not arranged are formed radially inside and radially outside the wall portions 136*a* and 137*a*.

The stress-relaxing thinned portions 136 and 137 may be formed by cutting or may be formed by forging. Since the amount of cutting increases in the case of the cutting, it is more advantageous to form the stress-relaxing thinned portions by means of the forging in terms of yield.

Accordingly, according to the impeller 108 of the above-described second embodiment, the spaces are formed radially inside and radially outside the balance holes 33. Thus, similar to the impeller 8 of a first embodiment, a tensile stress caused by the centrifugal force during rotation can be prevented from acting on the balance holes 33. As a result, it is possible to rotate the impeller 108 at a high speed.

Next, an impeller 208 in a third embodiment of the invention will be described with reference to the drawings.

Figure 7:
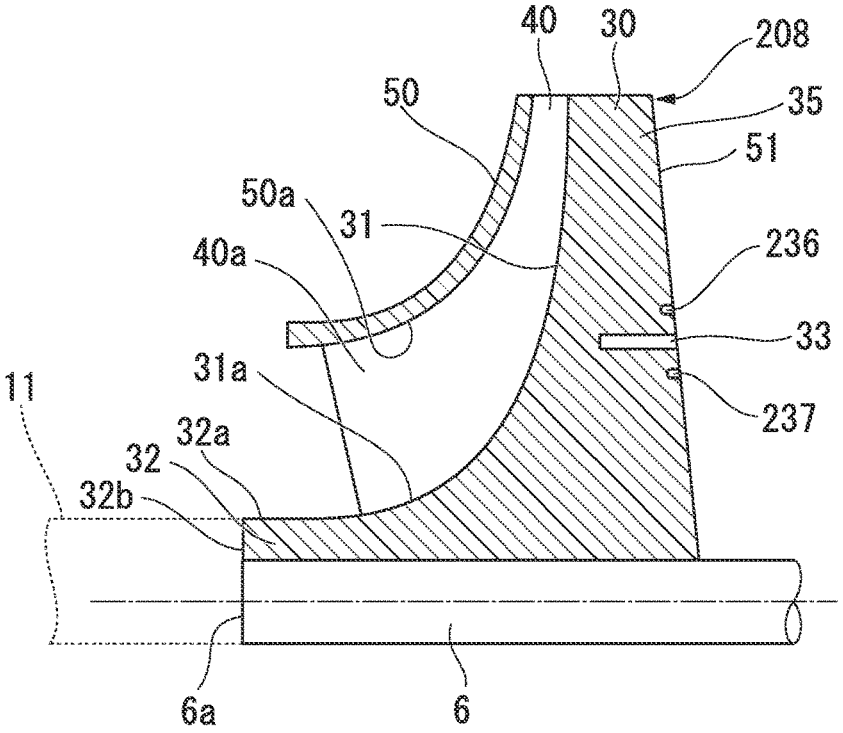
FIG. 7 is a meridian cross-sectional view correspond to FIG. 2 in a third embodiment of the invention.

As illustrated in FIG. 7, the impeller 208 in this embodiment, similar to the impeller 8 of the above-described first embodiment, has the balance holes 33 in the disc section 30. Stress-relaxing holes 236 and 237 are formed radially inside and radially outside each balance hole 33, in the disc section 30.

Figure 8:
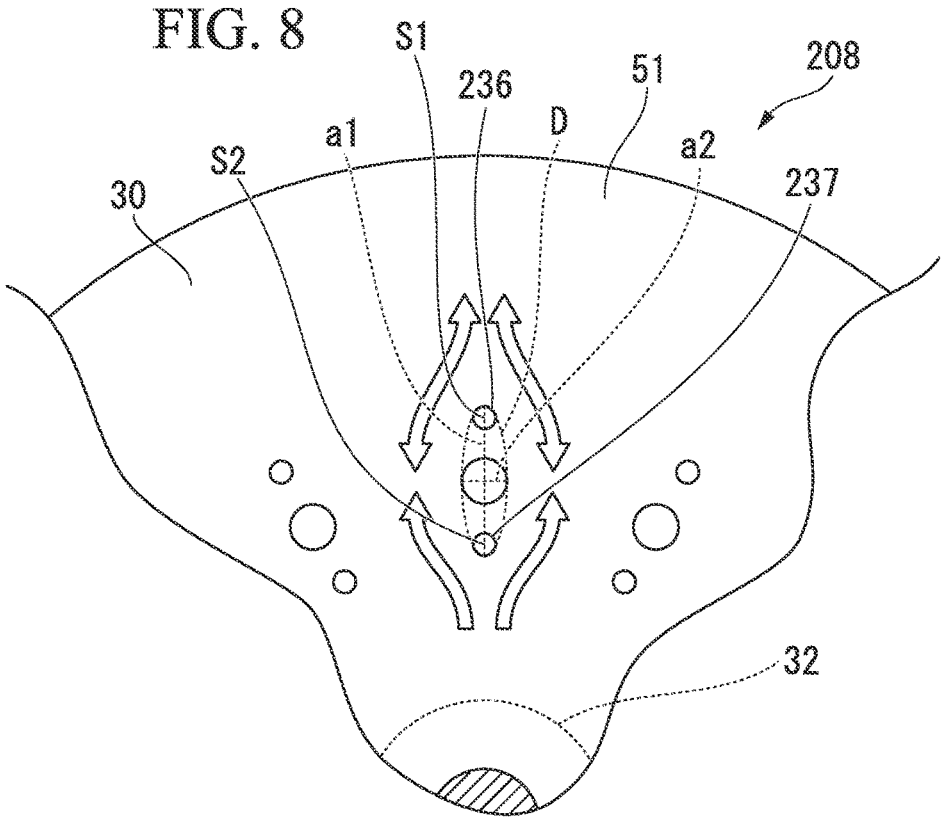
FIG. 8 is a back view correspond to FIG. 3 in the third embodiment of the invention.

As illustrated in FIG. 8, when viewed from a rear side in the axial direction, the stress-relaxing holes 236 and 237 are formed with such a position and a shape so as to form a pseudo-ellipse (illustrated by a dashed line in the drawing) D with respect to the balance hole 33. More specifically, a major axis a1 of the pseudo-ellipse D is directed to the radial direction of the impeller 8, and a minor axis a2 thereof is the diameter of the balance hole 33. The stress-relaxing holes 236 and 237 are formed in circular shapes respectively having distances between end portions on the major axis a1 side and two respective closest focal points s1 and s2 of the ellipse D as diameters, with the focal points s1 and s2 of D as centers.

The balance hole 33 and the stress-relaxing holes 236 and 237 are arranged so as not to overlap each other in the radial direction of the impeller 8. The balance hole 33 and the stress-relaxing holes 236 and 237 are formed to extend in the axial direction so as to become parallel to each other. It is preferable that the balance hole 33 and the stress-relaxing holes 236 and 237 be arranged as close to each other as possible. It is possible to further reduce the radial tensile stress to the balance hole 33 by bringing the balance hole 33 and the stress-relaxing holes 236 and 237 as close to each other as possible in this way.

Accordingly, according to the impeller 208 of the above-described third embodiment, the radial tensile stress as viewed from the axial direction can be detoured by the stress-relaxing holes 236 and 237, similar to a case where the elliptical hole is formed as illustrated by the arrow in FIG. 8, without forming an elliptical hole. Therefore, the stress that acts on the balance hole 33 can be efficiently lowered, and it is possible to make the impeller 310 correspond to higher-speed rotation by that much.

Next, an impeller 308 in a fourth embodiment of the invention will be described with reference to the drawings.

Figure 9:
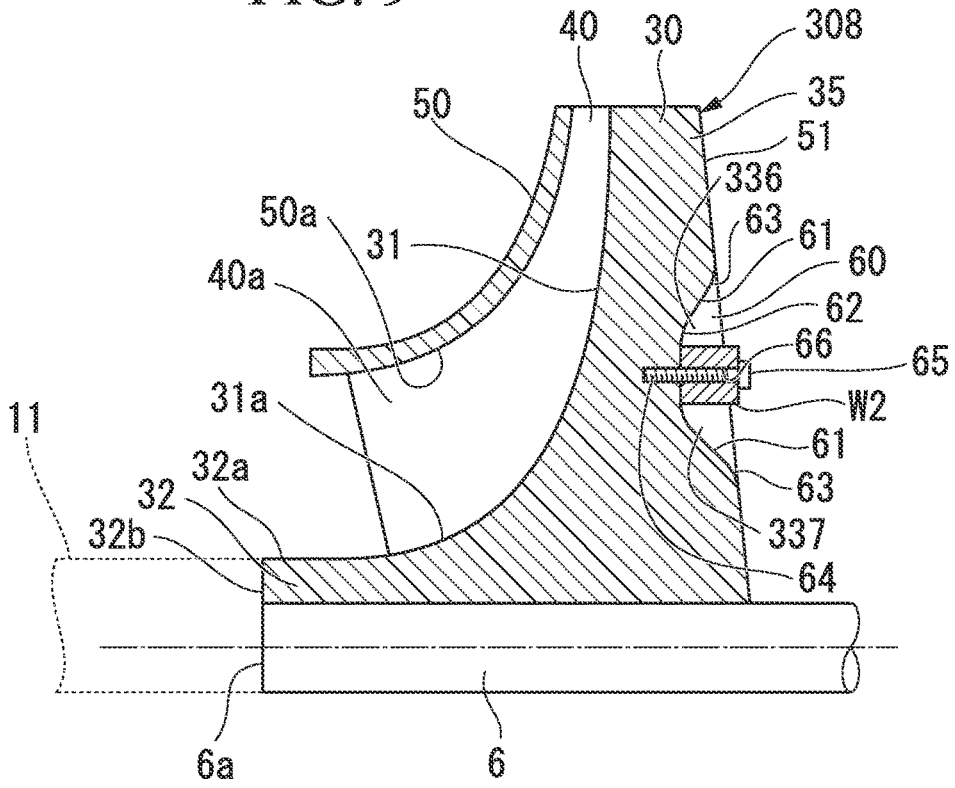
FIG. 9 is a meridian cross-sectional view correspond to FIG. 2 in a fourth embodiment of the invention.
Figure 10:
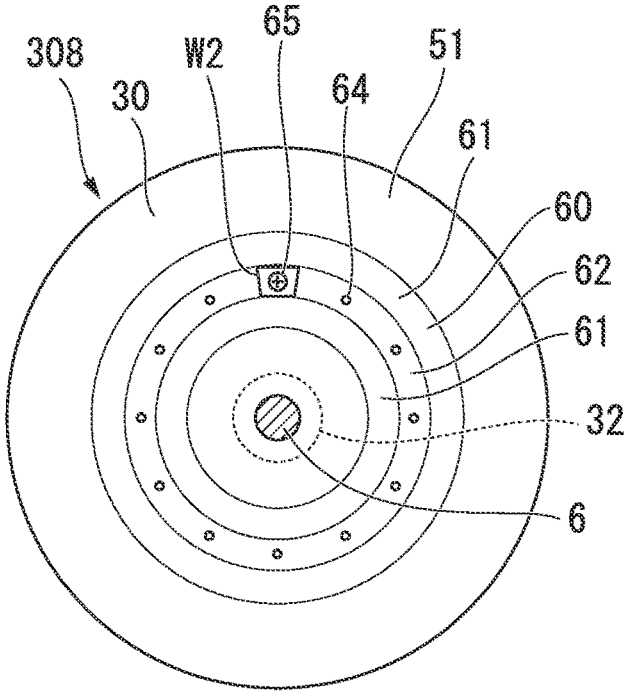
FIG. 10 is a back view correspond to FIG. 3 in the fourth embodiment of the invention.

As illustrated in FIGS. 9 and 10, in the impeller 308 of the fourth embodiment, an annular groove 60 centered on the pinion shaft 6 is formed in the rear surface 51 of the disc section 30. The groove 60 includes a pair of inner surfaces 61 that are further spaced apart from each other axially rearward, and a bottom surface 62 that connects the inner surfaces 61 on a front side in the axial direction. The inner surfaces 61 of the groove 60 and the rear surface 51 of the disc section 30 are connected together by gentle convex curved surfaces 63. A plurality of screw holes 64 are arranged at predetermined intervals in the circumferential direction of the disc section 30 in the bottom surface 62 of the groove 60. The screw holes 64 are formed so as to extend in the axial direction of the disc section 30.

A weight portion W2 having a width dimension slightly smaller than the radial width dimension of the bottom surface 62 is made attachable to and detachable from the groove 60. The weight portion W2 has a substantially rectangular parallelepiped shape, and a substantially central portion thereof is formed with a through-hole 66 for allowing a screw 65 to pass therethrough. By arranging the axis of the through-hole 66 on an extension line of the axis of each screw hole 64 and screwing the screw 65 into the screw hole 64, it is possible to fix the weight portion W2 to the disc body portion 35.

The weight portion W2 protrudes further axially rearward than the rear surface 51 of the disc section 30, in a state where the weight portion is attached to the disc body portion 35. Spaces are formed radially inside and radially outside the protruding portion. In other words, stress-relaxing portions 336 and 337 where the rear surface 51 of the disc body portion 35 is not arranged are formed radially inside and radially outside a radial inner surface 68 and a radial outer surface 69 of the weight portion W2. The inner surfaces 61 of the groove 60 that constitute the stress-relaxing portions 336 and 337 respectively function as axial wall portions that divert a radial stress in a meridian plane.

Accordingly, according to the impeller 308 of the fourth above-described embodiment, the weight portion W2 can be easily attached to and detached from the disc section 30. Additionally, since a tensile radial stress in the meridian plane diverts the through-hole 66 by forming the radial inner surface 68 and the radial outer surface 69, the stress concentration onto the through-hole 66 can be suppressed. Additionally, since the weight portion W2 is easily enlarged by forming the weight portion W2 in the rectangular parallelepiped shape, it is advantageous to increase the mass of the weight portion W2 more than that in a case where a weight portion has a male thread shape.

In addition, the invention is not limited to the configurations of the above-described embodiments, and design changes can be made without departing from the concept of the invention.

For example, a case where the number of the balance holes 33 is equal to or more than the number of the blade sections 40 has been described in the above-described respective embodiments. However, the number of the balance holes 33 may be equal to or less than the number of the blade sections 40.

Moreover, although a case where the balance holes 33 extend toward the direction of the axis has been described an example in the above respective embodiments, the balance holes 33 may be obliquely formed to the axis. Particularly, when an opening portion of each balance hole 33 is obliquely formed so as to be directed radially inward, it is possible to prevent the weight member W from being separated from the balance hole due to the centrifugal force caused during the rotation of the impeller 8.

Additionally, a case where the weight member W is fastened with a screw has been described as a method of fixing the weight member W to the balance hole 33. However, shrinkage fitting or the like may be used without being limited to screw fastening so long as the weight member W can be fixed to the inside of the balance hole 33.

Additionally, although a case where the centrifugal compressor 1 is the geared compressor has been described in the above-described respective embodiments, the centrifugal compressor is not limited to the geared compressor. For example, the invention can also be applied to impellers of other types of compressors. Moreover, arbitrary rotating machines using an impeller may be used without being limited to the compressor. Moreover, although the closed type impellers 8 and 9 including the cover section 50 have been described as an example, the invention can also be applied to an open type impeller that does not include the cover section 50.

Additionally, although a case where the stress-relaxing recesses 36 and 37 are respectively provided radially inside and radially outside the balance hole 33 has been described in the above-described first embodiment, only the stress-relaxing recess 36 may be provided radially outside the balance hole. When the stress-relaxing recess 36 is provided radially outside the balance hole 33 in this way, the mass of the impeller 8 on the radial outer side decreases. Thus, the tensile stress accompanying the centrifugal force can be suppressed. Additionally, a position where the tensile stress becomes high can be moved to the front side of the balance hole 33. As a result, even when only the stress-relaxing recess 36 is provided, it is possible to sufficiently reduce the stress concentration onto the balance hole 33.

Figure 11:
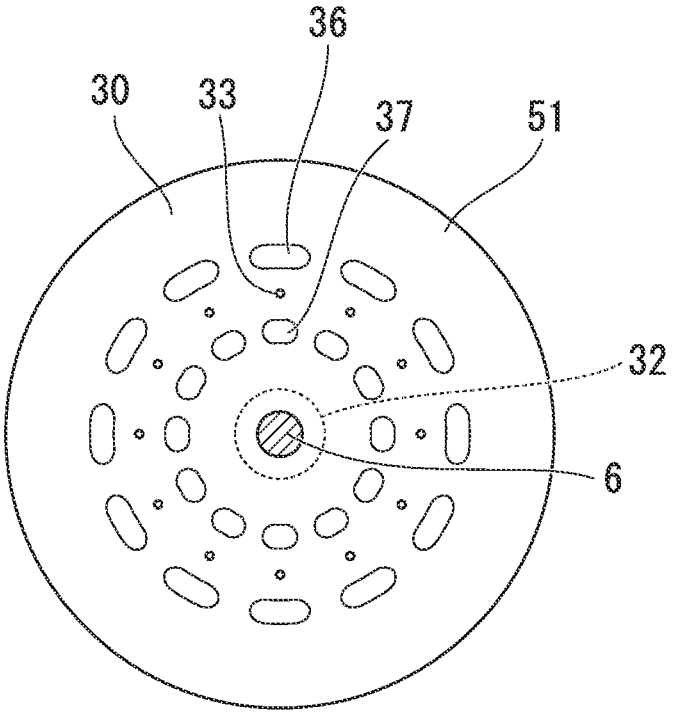
FIG. 11 is a back view correspond to FIG. 3 in a modification example of the first embodiment of the invention.

Moreover, although a case where the stress-relaxing recesses 36 and 37 are formed in an annular shape has been described in the above-described first embodiment, it is sufficient if the radial tensile stress to the balance hole 33 can be diverted, and the stress-relaxing recesses are not limited to this configuration. For example, as in a modification example illustrated in FIG. 11, the stress-relaxing recesses 36 and 37 may be provided only in the radial direction of a place where the balance hole 33 is arranged, and may be formed so as to become intermittent in the circumferential direction. Additionally, although a case where the inner surfaces 36*a* and 37*a* extend axially has been described, the inner surfaces are sufficient if the stress-relaxing recesses 36 and 37 can be formed and may be inclined to the axial direction.

Moreover, although a case where the spaces are formed radially inside and radially outside the balance hole 33 by cutting or forging has been described in the above-described second embodiment, the balance hole 33 and its periphery may be formed to protrude rearward from the rear surface 51.

Additionally, a case where the weight portion W2 is attached to the disc body portion 35 using the screw 65 as a fastening member has been described in the fourth above-described embodiment. However, the invention is not limited to this configuration; for example, the weight portion W2 may be fixed to the groove 60 by shrinkage fitting. In this case, it is possible to cut the weight portion W2 along the groove 60 to form a slit-like notch, thereby detaching the weight portion W2.

INDUSTRIAL APPLICABILITY

The invention can be widely applied to the impeller and the rotating machine in which the impeller is fixed to the rotating shaft, such as a turbo refrigerator or a small-sized gas turbine.

REFERENCE SIGNS LIST

8, 9: IMPELLER
30: DISC SECTION
33: BALANCE HOLE (ATTACHMENT HOLE)
36, 37: STRESS-RELAXING RECESS (STRESS-RELAXING DEVICE)
40: BLADE SECTION
36*a*, 37*a*, 61: INNER SURFACE (AXIAL WALL PORTION)
66: THROUGH-HOLE (ATTACHMENT HOLE)

68: RADIAL INNER SURFACE (AXIAL WALL PORTION)
69: RADIAL OUTER SURFACE (AXIAL WALL PORTION)
136, 137: STRESS-RELAXING THINNED PORTION (STRESS-RELAXING DEVICE)
136*a*: WALL PORTION (AXIAL WALL PORTION)
137*a*: WALL PORTION (AXIAL WALL PORTION)
236, 237: STRESS-RELAXING HOLE (STRESS-RELAXING DEVICE)
336, 337: STRESS-RELAXING PORTION (STRESS-RELAXING DEVICE)
W, W2: WEIGHT PORTION (WEIGHT)
R: ROTOR

The invention claimed is:

1. An impeller comprising:

a disc-shaped disc section that extends from a tube portion attached to a rotating shaft and extends radially outward from the tube portion; and a blade section that is provided in a front surface that is one side in an axial direction of the disc section, wherein the disc section is provided with an attachment hole for attaching a weight-adjusting weight, in a rear surface that is the other side in the axial direction of the disc section, and the disc section includes a stress-relaxing device provided on at least one radial side of the attachment hole in the rear surface to relax stress concentration caused by a centrifugal force in the attachment hole.

2. The impeller according to claim 1, wherein the stress-relaxing device includes an axial wall portion on at least one radial side of the attachment hole that diverts a radial stress in a meridian plane.

3. A rotating machine comprising:

a rotor having the impeller according to claim 1.

4. A rotating machine comprising:

a rotor having the impeller according to claim 2.

* * * * *